US006890117B2

(12) United States Patent
Hazzard

(10) Patent No.: US 6,890,117 B2
(45) Date of Patent: May 10, 2005

(54) WRITING PEN THAT CALCULATES BODY MASS INDEX

(75) Inventor: Thomas B. Hazzard, Ashville, NY (US)

(73) Assignee: Sun Coast Merchandise Corp, Commerce, CA (US)

( * ) Notice: Subject to any disclaimer, the term of this patent is extended or adjusted under 35 U.S.C. 154(b) by 0 days.

(21) Appl. No.: 10/916,652

(22) Filed: Aug. 11, 2004

(65) Prior Publication Data

US 2005/0079002 A1 Apr. 14, 2005

Related U.S. Application Data

(60) Provisional application No. 60/510,561, filed on Oct. 10, 2003.

(51) Int. Cl.[7] ..... B43K 29/00

(52) U.S. Cl. ..... 401/195; 401/52; 235/79.5; 235/87 R; 235/87 A

(58) Field of Search ..... 401/52, 195; 235/64, 235/79.5, 87 R, 87 A

(56) References Cited

U.S. PATENT DOCUMENTS

| | | | | |
|---|---|---|---|---|
| 2,646,220 A | * | 7/1953 | Weiser | 401/195 |
| 2,777,636 A | * | 1/1957 | Weiser | 401/195 |
| 4,007,364 A | | 2/1977 | Ojima et al. | |
| 4,984,494 A | | 1/1991 | Yang | |
| 5,028,764 A | | 7/1991 | Kuhlengel | |
| 6,104,603 A | | 8/2000 | Wang | |

* cited by examiner

*Primary Examiner*—Tuan Nguyen
(74) *Attorney, Agent, or Firm*—Brian Carpenter

(57) ABSTRACT

A writing instrument that includes tables and operational elements for calculating the Body Mass Index (BMI) of a person. In general, the BMI of a person is calculated based on the weight and height of the person. The present invention is a writing instrument which combines a writing instrument with a measuring device in one lightweight and commonly used type of device, thereby freeing the user of the need to refer to complicated charts or other technical materials. The writing implement has a first end which includes the writing tip portion and a second end which includes the tables and operational elements used to calculate the individual's BMI.

4 Claims, 1 Drawing Sheet

WRITING PEN THAT CALCULATES BODY MASS INDEX

This application claims priority to provisional application No. 60510561 filed Oct. 10, 2003 as a conversion of that provisional application to a non-provisional application.

BACKGROUND OF THE INVENTION

The present invention generally relates to a writing instrument that includes a means for calculating the Body Mass Index (BMI) of a person. In general, the Body Mass Index (BMI) of a person is calculated based on the weight and height of the person. For example, a BMI may be determined based on the following equation: $M/L^2$, where M is the body weight in kilograms, and L is the body height in meters. It is recognized that other equations may be used for calculating the BMI. For instance, the body weight may be expressed in pounds, and the body height by inches.

The BMI is a useful indicator of a person's body composition and can be used in various applications. For example, health-care providers can use a BMI to determine the proper amount of medication to prescribe for a patient. The BMI of a patient is used often in prescribing medication for treating diabetes and other illnesses.

Wall charts or reference books containing a BMI scale for patients are commonly used in the health care industry. The BMI chart can be hung on the wall of an examination room so that a health-care provider may refer to the chart. Also, various electronic devices are known for calculating the BMI of a patient. These devices have electronic input sensors for entering personal body data, electronic means for calculating the BMI based on the entered body data, and a graphics window for electronically displaying the BMI and other related information.

In a routine physical examination of a patient, a health-care provider must handle and use a large number of separate products including, for example, various medical instruments, pieces of diagnostic equipment, stethoscopes, height/weight scales, writing pens, patient charts, prescription pads, and the like. Although conventional electronic devices may be effective in calculating a patient's BMI, the health-care provider must handle and operate these devices separately in addition to various other items. Many health-care providers would like to reduce the number of items that they must handle during the examination of a patient.

U.S. Pat. No. 5,028,764 to Kuhlengel discloses a pen with rotatable cylindrical elements that is used to perform a simple calculation in the multiplication of two numbers. U.S. Pat. No. 6,104,603 to Wang discloses a writing pen with an integral electronic calculator including printed circuit board, keyboard and power supply. In each of these patents, the invention provides its user no capability to perform a specific non-linear calculation, as the former will not permit a non-linear calculation and the latter relies upon the user to supply a formula, in addition to its dependence on electronic, rather than manual components. Therefore, neither patent involves a device which may be manually employed to quickly determine the numerical outcome of a specific non-linear relationship equation, such as the Body Mass Index of a person, based jointly on multiple variables, in this case the two factors being their height and weight.

SUMMARY OF THE INVENTION

The present invention addresses and overcomes the need for the Health-care provider to have at hand the above described diagnostic equipment or manuals by providing a writing instrument that combines a writing implement with a manual calculator for determining the BMI of a patient. Health-care providers can use the proposed writing instrument to determine the BMI of a patient, and as a writing pen for recording information in patient charts, submitting prescriptions, and the like. The present invention combines a writing instrument with a measuring device in one lightweight and commonly used type of device, thereby freeing the user of the need to refer to complicated charts or other technical materials. These and other objects, features, and advantages of the invention are evident from the following description and attached drawings. In one preferred embodiment of the invention, the writing implement has a first end which includes the writing tip portion and a second end which includes the tables and operational elements used to calculate the individual's BMI.

Referring to FIGS. 1 and 2 attached hereto, the writing instrument of the present invention includes an elongated, cylindrical housing that is tapered at a first end. The tapered end includes an opening for the writing point such as a retractable pen insert located within the housing. The instrument may also include a rubber grip handle surrounding and disposed radially outwardly about the first end so that a user can grip the instrument and write with it more easily. The second end of the instrument may include a clip for attaching it to a clothing pocket or other object. The second end may further include a click or push button that may be pushed to advance and retract the pen insert as needed.

The writing instrument includes a body height scale printed on its outer surface. The height scale extends longitudinally along a surface portion of the instrument. The height scale also contains a sliding marker that is moved to a position on the scale indicating the patient's actual height. The sliding marker also identifies the patient's BMI as further discussed below. In the embodiment shown in FIGS. 1 and 2, the height scale uses inches to record the patient's height. However, it is recognized that a metric scale could be used in alternative embodiments. The instrument further includes an elongated, transparent window that extends in parallel to the height scale.

In addition, the writing instrument includes a rotatable dial having a body weight scale printed on its surface. The dial may include two rotatable segments. For example, one dial segment may be printed with indicia representing a weight range of 90 to 210 pounds. The other dial segment may be printed with indicia representing a weight range of 215 to 330 pounds. The different weight scales may be of the same color or different colors. For example, in one embodiment, the weight scale of 90 to 210 pounds is colored blue, while the weight scale of 215 to 330 pounds is colored red. The dial is connected to a rotatable cylinder located within the instrument's elongated housing. The rotatable cylinder includes a BMI scale printed on its surface. In practice, the user first inputs the weight of the patient by rotating the dial on the weight scale to a set point in indicating the patient's actual weight. (The weight indicator is similar to the Y axis on a graph.) Then, the user inputs the height of the patient by moving the sliding marker along the height scale to a set point indicating the patient's actual height. (The height indicator is similar to the X axis on a graph.) The rotatable cylinder that is located within the housing of the instrument rotates along with the rotation of the dial, thereby displaying the BMI based on the weight and height input settings. The BMI reading is visible on the cylinder through the elongated, transparent window. The rotatable cylinder that records the BMI can be colored, so that the BMI reading is immediately noticeable. For example, in one embodiment, the rotatable cylinder is colored yellow. As the rotatable cylinder would necessarily be limited in size, it may become necessary to include tow or more rotatable segments to increase the weight range for which its use may be suitable. For example, one dial segment may be printed with indicia representing a weight range of 90 to 210 pounds. The other dial segment may be printed with indicia representing a weight range of 215 to 330 pounds. In this example, two colors would be used for the BMI values printed on the rotatable cylinder such that the appropriate BMI value would be readily discernable to the user based upon the color of BMI values corresponding to the rotation of either the first or second rotatable segment according to the patient's weight. As discussed above, the BMI of a person has many useful applications in medical and other fields. For instance, the BMI can be used to prescribe the proper amount of medicine for a patient. A health-care provider can use the unique writing instrument of this invention for calculating the BMI of a patient, and as a writing pen.

DETAILED DESCRIPTION OF THE INVENTION

Figure 1:
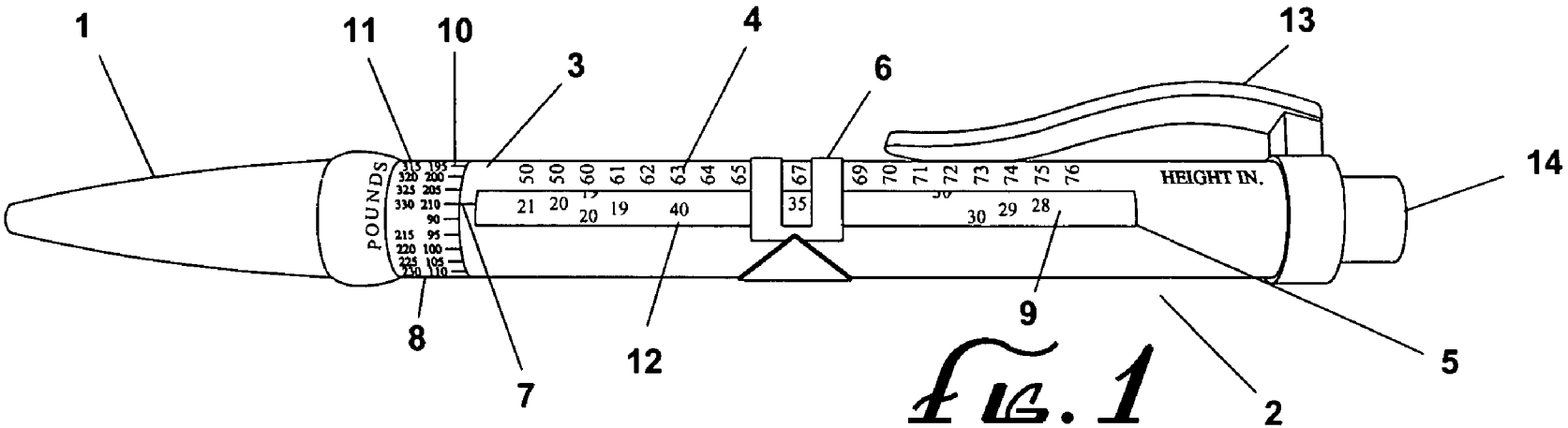
FIG. 1 is a perspective view of one embodiment of the writing instrument of the present invention, including the height scale along the length of the second end of the pen and the transparent window through which the user may read the BMI at the sliding marker position.
Figure 2:
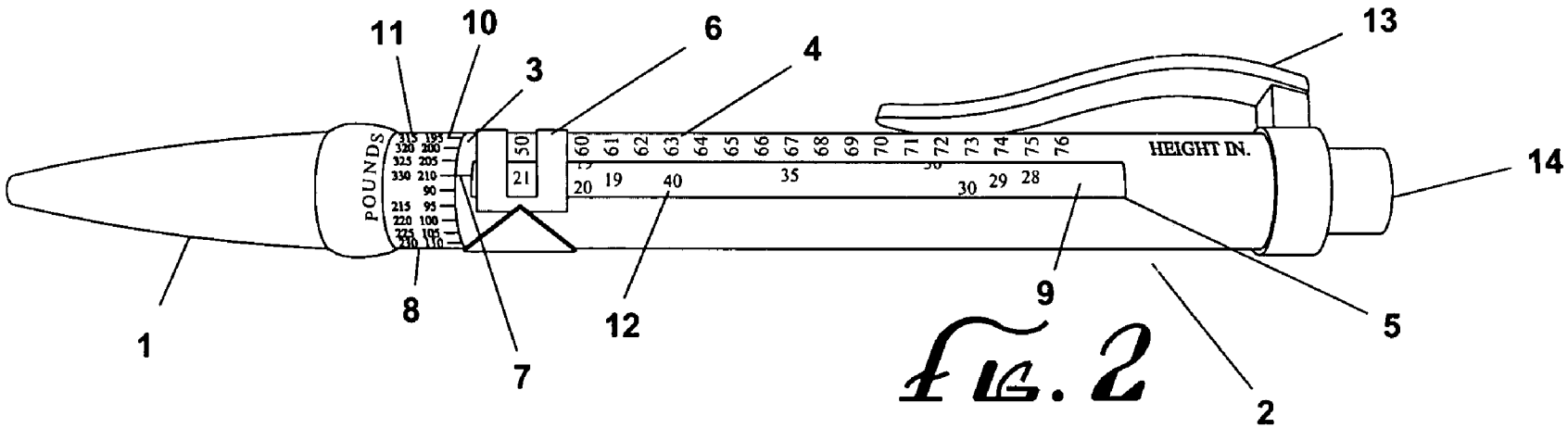
FIG. 2 is second view of the writing instrument in FIG. 1 showing the various components of the instrument, including the rotating dial for weight selection, the BMI sliding marker indicator window at a lower position and the cylinder on which the red and blue BMI values are printed.

The present invention relates to a writing instrument which includes a means by which its user may quickly determine the Body Mass Index (BMI) of an individual of known height and weight. In a preferred embodiment, the writing instrument as shown in FIGS. 1 and 2 comprises a first end (1) and a second end (2). The first end, through which a writing tip may extend and/or retract is attached to the second end such that said writing instrument is a unitized assembly.

In the preferred embodiment, the second end comprises am outer surface (3), on which a body height scale (4) is printed, to correspond with the height component of the BMI calculation. Said outer surface further includes an elongated transparent window (5) that extends in parallel to the height scale. A sliding marker (6) is retained by the height scale (4) and transparent window (5), such that said sliding marker may be manually slid lengthwise along the transparent window (5) to a position to correspond with the individual's actual body height. The outer surface (3) includes a designation (7), such as a short axial line mark, at the midpoint of the distal end of the elongated transparent window (5).

A rotatable dial (8) having a body weight scale printed on its surface is affixed to the second end (2) such that it is connected to a rotatable cylinder (9) located within the instrument's elongated housing within the second end. The body weight scale designations of the rotatable dial (8) are segmented with incremental axial marks (10) printed on the circumference of the dial. The dial (8) has at least one rotatable segment (11) and may have two or more rotatable segments to increase the weight range for which its use may be suitable. For example, one dial segment may be printed with indicia representing a weight range of 90 to 210 pounds. The other dial segment may be printed with indicia representing a weight range of 215 to 330 pounds. The different weight scales may be of the same color or different colors. The attached rotatable cylinder (9) includes a BMI scale printed on its surface (12), which is partially visible through the transparent elongated window (5) and through the sliding marker (6).

To quickly calculate determine the individual's BMI, the user of the invention moves the sliding marker (6) to a position wherein the height scale (4) number corresponding to the individual's actual height is centered in the transparent rectangle of the sliding marker (6). The user then turns the rotatable dial (8) to a position wherein the printed body weight scale number and axial mark (10) most closely corresponding to the individual's actual weight is aligned with the designation (7) to center the desired weight scale numerical value in the elongated transparent window (5). Having set the sliding marker (6) to correspond with the individual's height and the rotatable dial to correspond to the individual's weight, the user would look through the sliding marker at the elongated transparent window (5) and the number printed on the rotating cylinder visible through the rectangular window of the sliding marker (6) would be the individual's BMI.

In other embodiments, the writing instrument may be a pencil, highlighter or other printing device other than a pen. The writing instrument may include a clip (13) for attachment to the user's pocket or other point of attachment, with the clip having a surface area appropriate for imprinting of advertising or other graphics. The printing of advertisement in this area greatly enhances the practical purposes of this pen as innumerable vendors and suppliers would be desirous of utilizing these devices as an advertising vehicle to the medical and pharmaceutical industries, among others. The writing instrument may further include a click or push button (14) that may be pushed to advance and retract the pen insert as needed.

It is appreciated by those skilled in the art that various changes and modifications can be made to the illustrated embodiments and description herein without departing from the spirit of the present invention.

I claim:

1. A writing instrument comprising:

an elongated housing having a first end and a second end;

said first end including a means for writing comprising of an ink or other writing tip, with said writing tip extending from an axial orifice in the first end;

said second end having an outer surface rotatably engaged to a rotatable dial having a body weight scale with segmented designations printed around the circumference of said dial;

said dial rigidly affixed to a rotatable cylinder with said rotatable cylinder disposed radially inwardly of the housing within said second end and having body mass index numbers printed on the outer circumference of said cylinder; and said second end having a height scale printed longitudinally along its outer surface and an elongated transparent window that extends longitudinally along said outer surface in parallel to the height scale; and said transparent window having a sliding member including a transparent viewing area.

2. The writing instrument of claim 1, wherein a clip is attached to the second end, said clip having a surface on which advertising or graphical material may be printed.

3. A method to determine the body mass index of an individual by means of using a writing instrument comprising of:

an elongated housing having a first end and a second end;

said first end comprising a means for writing including an ink or other writing tip, with said writing tip extending through an axial orifice in the first end;

said second end having an outer surface rotatably engaged to a rotatable dial having a body weight scale with segmented designations printed around the circumference of said dial;

said dial rigidly affixed to a rotatable cylinder with said rotatable cylinder disposed radially inwardly of the housing within said second end and having body mass index numbers printed on the outer circumference of said cylinder;

said second end having a height scale printed longitudinally along its outer surface and an elongated transparent window that extends longitudinally along said outer surface in parallel to the height scale; and said transparent window having a sliding member including a transparent viewing area.

4. A method to determine the body mass index of an individual comprising the steps of:

moving a sliding marker of a writing instrument to a position wherein a height scale number corresponding to the individual's actual height is centered in a transparent viewing area of said sliding marker;

turning a rotatable dial on said writing instrument to a position wherein a printed body weight scale number and axial mark most closely corresponding to the individual's actual weight is aligned with the designation to center the desired weight scale numerical value in an elongated transparent window; and looking through a sliding marker at said elongated transparent window to locate the number printed on a rotating cylinder visible through an opening of said sliding marker.

* * * * *